US011684116B2

(12) United States Patent
Mason et al.

(10) Patent No.: US 11,684,116 B2
(45) Date of Patent: Jun. 27, 2023

(54) MID-SOLE FOR SHOES

(71) Applicant: DIADORA S.P.A., Caerano di San Marco (IT)

(72) Inventors: Angelo Mason, Caerano di San Marco (IT); Enrico Polegato Moretti, Crocetta del Montello (IT)

(73) Assignee: DIADORA S.P.A., Caerano di San Marco (IT)

( * ) Notice: Subject to any disclaimer, the term of this patent is extended or adjusted under 35 U.S.C. 154(b) by 622 days.

(21) Appl. No.: 16/316,503

(22) PCT Filed: Jul. 5, 2017

(86) PCT No.: PCT/EP2017/066736
§ 371 (c)(1),
(2) Date: Jan. 9, 2019

(87) PCT Pub. No.: WO2018/011030
PCT Pub. Date: Jan. 18, 2018

(65) Prior Publication Data

US 2021/0282496 A1 Sep. 16, 2021

(30) Foreign Application Priority Data

Jul. 13, 2016 (IT) ..... 102016000073012

(51) Int. Cl.
*A43B 13/12* (2006.01)
*A43B 13/04* (2006.01)
*A43B 13/20* (2006.01)

(52) U.S. Cl.
CPC ..... *A43B 13/125* (2013.01); *A43B 13/04* (2013.01); *A43B 13/206* (2013.01)

(58) Field of Classification Search
CPC ..... A43B 13/206; A43B 13/181; A43B 13/04; A43B 13/125; A43B 13/226;
(Continued)

(56) References Cited

U.S. PATENT DOCUMENTS 3,231,454 A * 1/1966 Williams ..... F16F 9/0481 428/132
4,521,979 A 6/1985 Blaser
(Continued)

FOREIGN PATENT DOCUMENTS

CN 1053884 A 8/1991
CN 201039775 Y 3/2008
(Continued)

OTHER PUBLICATIONS

"Kraton D-2104 material property data" via MatWeb. Accessed on Jul. 15, 2021. http://www.matweb.com/search/datasheet.aspx?matguid=4bc8595ac2ad460a95b965b61108affc&ckck=1. (Year: 2021).*
(Continued)

*Primary Examiner* — Jameson D Collier
*Assistant Examiner* — Matthew R Marchewka
(74) *Attorney, Agent, or Firm* — Cantor Colburn LLP

(57) ABSTRACT

A mid-sole for shoes includes a body on which there is a lower portion for joining to a tread and an upper portion for supporting an insole. The upper portion includes a plurality of elastically compressible protrusions that protrude toward the outside of the body from a bottom surface of the upper portion.

8 Claims, 3 Drawing Sheets

(58) Field of Classification Search
CPC ..... A43B 13/145; A43B 13/20; A43B 7/146; A43B 13/184; A43B 3/0036; A43B 7/082; A43B 7/087; A43B 7/14; A43B 7/1405; A43B 7/1467; A43B 7/1464
USPC ..... 36/25 R, 28, 141
See application file for complete search history.

(56) References Cited

U.S. PATENT DOCUMENTS

| | | | | | |
|---|---|---|---|---|---|
| 5,607,749 | A * | 3/1997 | Strumor | A61H 39/04 | 428/156 |
| 6,434,859 | B1 * | 8/2002 | Kim | A43B 7/142 | 36/43 |
| 6,681,907 | B2 * | 1/2004 | Le | B60R 21/04 | 188/371 |
| 6,754,982 | B2 * | 6/2004 | Reed | A43B 7/1425 | 36/29 |
| 8,381,872 | B2 * | 2/2013 | Alexander | G10K 11/16 | 181/296 |
| 9,155,355 | B2 * | 10/2015 | Diepenbrock | A43B 17/023 | |
| 2002/0184791 | A1 * | 12/2002 | Ko | A43B 7/146 | 36/141 |
| 2005/0000116 | A1 * | 1/2005 | Snow | A43B 3/128 | 36/28 |
| 2008/0022561 | A1 * | 1/2008 | Klavano | A43B 7/146 | 36/141 |
| 2009/0293311 | A1 * | 12/2009 | Sun | A43B 13/145 | 36/91 |
| 2010/0146824 | A1 * | 6/2010 | Sensini | A43B 7/125 | 36/141 |
| 2013/0283638 | A1 * | 10/2013 | Diepenbrock | A43B 17/03 | 36/44 |
| 2014/0075777 | A1 * | 3/2014 | Bruce | A43B 7/1435 | 36/29 |
| 2016/0183627 | A1 * | 6/2016 | Ho | A43B 17/08 | 36/141 |

FOREIGN PATENT DOCUMENTS

| | | | | |
|---|---|---|---|---|
| CN | 102783754 | A | | 11/2012 |
| DE | 806647 | C | | 5/1952 |
| DE | 3440206 | A1 | | 5/1985 |
| EP | 0780063 | A1 | | 6/1997 |
| EP | 0875163 | A2 | | 11/1998 |
| EP | 1222868 | A1 | | 7/2002 |
| EP | 1557104 | A1 | | 7/2005 |
| JP | H05503451 | A | | 6/1993 |
| JP | H08506610 | A | | 7/1996 |
| JP | H10305495 | A | | 11/1998 |
| JP | 2009537185 | A | | 10/2009 |
| KR | 20090004464 | A | | 1/2009 |
| KR | 20110004572 | A | * | 1/2011 |
| KR | 1020110045439 | A | | 5/2011 |
| WO | 9111928 | A1 | | 8/1991 |
| WO | 9418263 | A1 | | 8/1994 |
| WO | 2015097015 | A1 | | 7/2015 |

OTHER PUBLICATIONS

CN Office Action dated Sep. 2, 2020 re: Application No. 201780043469.5, pp. 1-14, citing: CN1053884A, CN201039775Y, U.S. Pat. No. 4,521,979A, KR20090004464A, DE440206A1, EP1222868B1, DE806647C and EP1557104A1.

International Search Report dated Sep. 1, 2017 re: Application No. PCT/EP2017/066736, pp. 1-4, citing: WO 91/11928 A1, CN 102 783 754 A, EP 0 780 063 A1, EP 1 557 104 A1, DE 806 647 C, EP 0 875 163 A2 and EP 1 222 868 A1.

Written Opinion dated Sep. 1, 2017 re: Application No. PCT/EP2017/066736, pp. 1-6, citing: WO 91/11928 A1, CN 102 783 754 A, EP 0 780 063 A1, EP 1 557 104 A1, DE 806 647 C, EP 0 875 163 A2 and EP 1 222 868 A1.

JP Office Action dated Jul. 20, 2021 re: Application No. 2019-523169, pp. 1-2, citing: JP H5-503451 A, CN 201039775 Y, JP 2009-537185 A, KR 10-2011-0045439 A, U.S. Pat. No. 4,521,979 A, WO 2015/097015 A1, WO 91/11928 A1, US 2009/0293311 A1, JP H8-506610 A, WO 94/18263 A1 and JP H10-305495 A.

* cited by examiner

MID-SOLE FOR SHOES

TECHNICAL FIELD

The present disclosure relates to a mid-sole for shoes.

BACKGROUND

Nowadays it is known to provide a mid-sole for shoes that usually has a contained thickness and is made with elastically flexible material, both in order to conform anatomically to the foot as a function of the configurations it assumes during walking or running, and also in order to act as a shock absorber.

The mid-sole, in fact, must be capable of adequately decreasing the excessive load in the impact area of the foot with respect to the ground, and elastically return part of the energy received during the normal heel-toe stride, while simultaneously decreasing muscular stress and loads to the detriment of the muscular-skeletal apparatus.

Nowadays, in order to meet such needs, mid-soles are used whose principal functions are, therefore, the absorption of impact during the normal heel-toe stride, elastic yield for transferring loads from the heel to the toes, and flexibility for the thrust phase.

It is therefore known to provide a mid-sole for shoes which is made of expanded polyurethane (EP) or of ethylene vinyl acetate (EVA), which make up about 90% of the mid-sole and are characterized by a single rigidity level over the entire length of the mid-sole, from the heel to the toes.

A drawback that is found in the cited known art consists in that the mid-sole made of EVA or of EP adapts slowly to the shape of the sole of the foot of the user, and therefore it is not capable of ensuring an adequate anatomical adaptation during use, rendering the shoe rather uncomfortable.

This drawback is felt more for users who suffer from overpronation or from excessive supination.

Pronation is a normal part of running that consists of the natural tendency of the foot to rotate inward during walking or running, in order to absorb shocks; some people have an excessive rotation (overpronation), which continues after the impact of the foot on the ground, or an insufficient rotation of the foot (excessive supination), both of which influence the manner of running and can increase the risk of injuries and generate tendinitis both in the foot and in the knees, plantar fasciitis and other muscular inflammations.

To seek to overcome these drawbacks, it is known to insert rigid supporting elements, for example in the form of vertical walls of greater or lesser thickness, in the medial wall of the mid-sole, at the plantar arch.

Such rigid elements are uncomfortable and inconvenient because they do not adapt to the shape of the sole of the foot, since they are not three-dimensionally and anatomically shaped to fit the foot.

Conventional mid-soles are often reinforced in the waist area by way of the use of added materials the function of which is to lighten and cushion the mid-sole; the use is known of pads, arranged in the heel region, which contain air or gel or similar materials, which increase impact absorption and are adapted to deform, elastically absorbing the energy of impact with the ground.

A drawback of such conventional solutions consists of a loss of impact absorption, with consequent loss of elasticity, owing to the fact that, as a consequence of repeated compressions during use, over time the mid-sole loses the shock-absorption properties and the elastic return of the thrust phase; this can be due both to the characteristics of the principal material with which it is made, and to the use of pads that can easily deflate and break if subjected to the repeated compressions that arise during sporting activity.

SUMMARY

The aim of the present disclosure is to provide a mid-sole for shoes that is capable of overcoming the above mentioned drawbacks of conventional mid-soles.

In particular, the present disclosure develops a mid-sole that offers improved characteristics for cushioning and thrust with respect to conventional mid-soles.

The present disclosure obtains a mid-sole that ensures that the cushioning and thrust capacities are maintained over time.

The disclosure also provides a mid-sole that ensures an adequate level of anatomical adaptation is reached including for persons with problems of overpronation or of excessive supination.

This aim and these and other advantages which will become better apparent hereinafter are achieved by providing a mid-sole for shoes according to claim 1.

BRIEF DESCRIPTION OF THE DRAWINGS

Further characteristics and advantages of the disclosure will become better apparent from the detailed description of a particular, but not exclusive, embodiment of the disclosure, which is illustrated by way of non-limiting example in the accompanying drawings wherein.

DETAILED DESCRIPTION OF THE DRAWINGS

Figure 1:
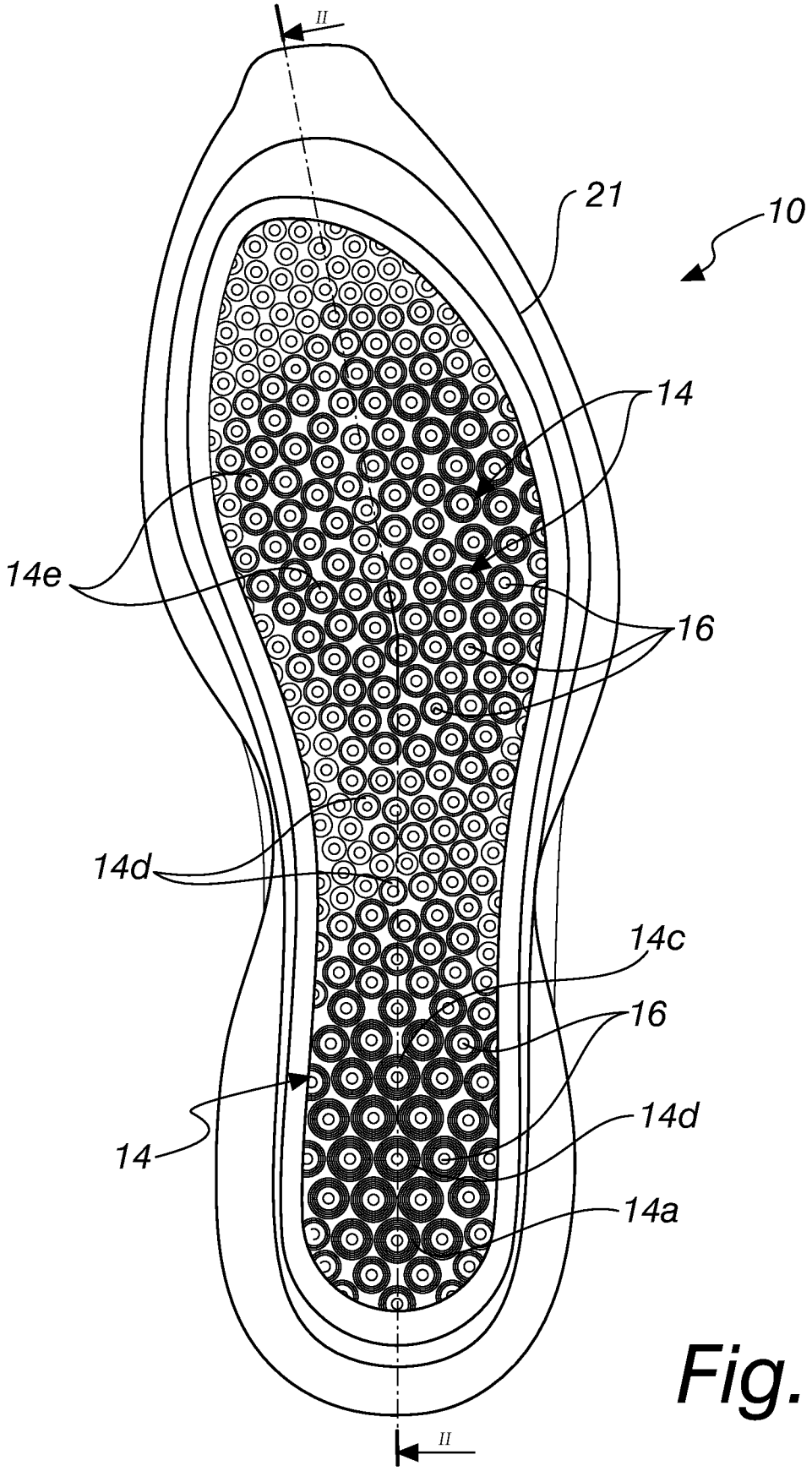
FIG. 1 is a view from above of a mid-sole according to the disclosure.

With reference to FIGS. 1-4, a mid-sole for shoes according to the disclosure is generally designated with the reference numeral 10.

The mid-sole 10 comprises a body 11 on which there is a lower portion 12 for joining to a tread, and an upper portion 13 for supporting an insole.

The peculiarity of the mid-sole 10 according to the disclosure lies in the fact that the upper portion 13 comprises a plurality of elastically compressible protrusions 14, 14*a*, 14*b*, 14*c*, 14*d*, 14*e* that protrude toward the outside of the body 11 from a bottom surface 15 of the upper portion 13.

In the present exemplary embodiment, each one of the elastically compressible protrusions 14, 14*a*, 14*b*, 14*c*, 14*d*, 14*e* has a blind cavity 16 that is open toward the outside of the body 11.

It should therefore be understood that such elastically compressible protrusions can be provided solid, i.e. without blind cavity.

The body 11 is contoured to contain the sole of a foot.

Figure 4:
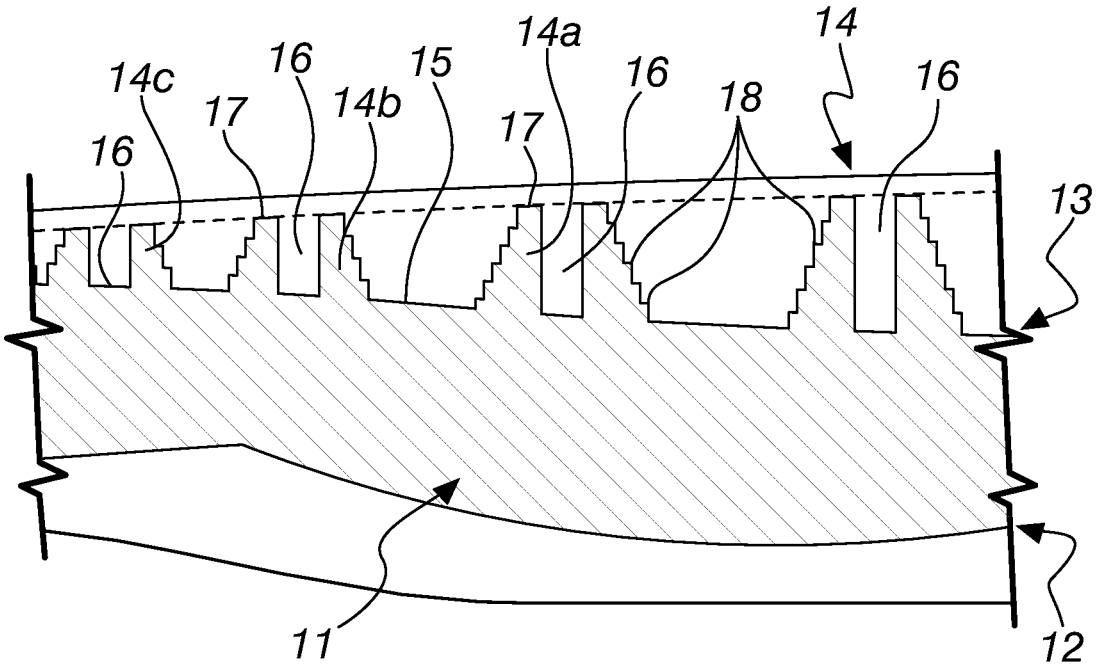
FIG. 4 is a detail of a portion of the cross-sectional side view shown in FIG. 3.

Each protrusion 14, 14*a*, 14*b*, 14*c*, 14*d* and 14*e*, in the present exemplary embodiment, is constituted by a stepped frustum-shaped raised portion 18, as can clearly be seen in the detail in FIG. 4, the number of such steps therefore varying with the height, with respect to the bottom surface 15 from which they protrude, of the protrusion 14, 14*a*, 14*b*, 14*c*, 14*d*, 14*e*.

It should be understood that the protrusions 14, 14, 14*a*, 14*b*, 14*c*, 14*d*, 14*e* can also have another shape, for example cylindrical.

It should be understood that the protrusions 14, 14, 14*a*, 14*b*, 14*c*, 14*d*, 14*e* can have a different shape from one protrusion to the next, according to the region on which they are arranged.

The term blind cavity 16 means a non-through cavity, closed at the other end with respect to the opening outward.

The blind cavity 16 is coaxial to the frustum-shaped contour of the protrusion 14, 14*a*, 14*b*, 14*c*, 14*d*, 14*e* in which it is defined.

The blind cavity 16 is, for example, cylindrical.

The bottom surface 15 is plantar-shaped.

Figure 2:
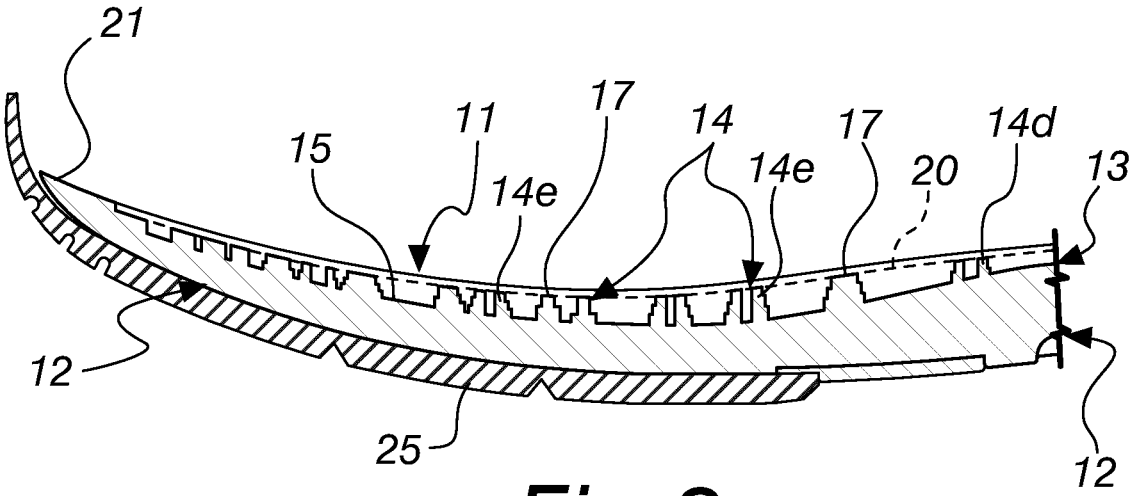
FIG. 2 shows a portion of a cross-sectional side view taken along the line II-II of FIG. 1.
Figure 3:
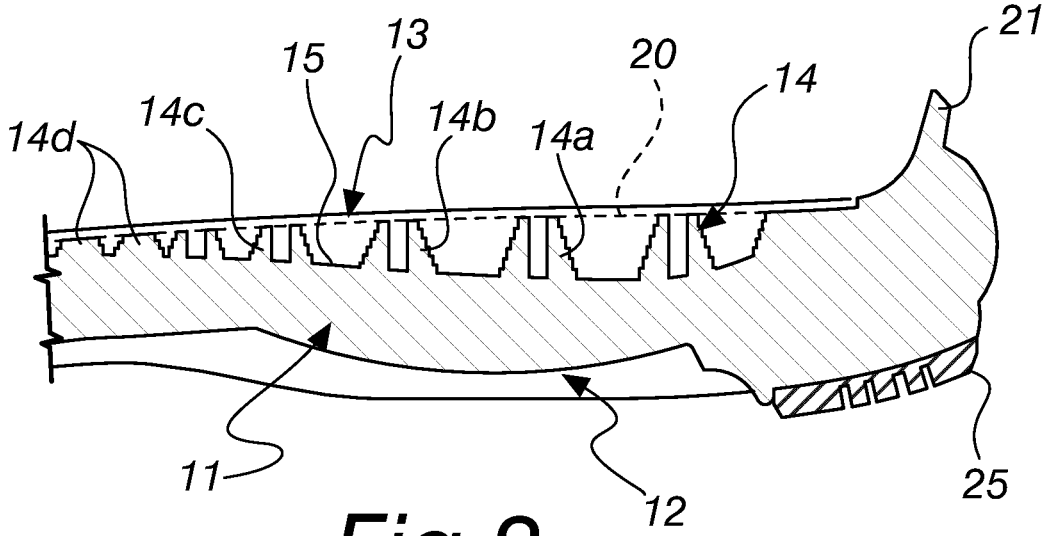
FIG. 3 shows another portion of the cross-sectional side view taken along the line II-II of FIG. 1.

Each protrusion has an end surface 17 that is flat, so as to define with the other end surfaces 17 of the other protrusions an external surface for resting an insole, shown with dotted lines in FIGS. 2 and 3 and designated therein with the reference numeral 20, which has an anatomical shape.

The height of each protrusion 14, 14*a*, 14*b*, 14*c*, 14*d*, 14*e* varies according to the anatomical shape of the bottom surface 15 in the region of the mid-sole 10 of which the protrusion is a part.

For example the protrusions 14*a*, 14*b* and 14*c* of the heel region are higher than the protrusions 14*d* of the waist region.

Similarly the protrusions 14*e* of the metatarsal region are higher than the protrusions 14*d* of the waist region, but lower than the protrusions 14*a*, 14*b* and 14*c* of the heel region.

The protrusions 14*d* of the waist region, which are lower, can for example be cylindrical.

The mid-sole 10 is surrounded by an outer perimetric edge 21, for containing an insole.

The mid-sole 10 is provided in a single piece, using a material that has elastic characteristics, in order to facilitate its return to the original shape during the use of the shoe, and has a density preferably comprised between (0.15-1.20) g/cm$^3$ and a hardness preferably comprised between (15-60) Shore A, such as for example styrene-butadiene-styrene (SBS) rubber, natural rubber (NR), rubber and ethylene vinyl acetate (EVA), thermoplastic polyurethane (TPU) and two-component (polyol-isocyanate) expanded polyurethane (EP).

The peculiar stepped frustum-shape of the protrusions 14, 14*a*, 14*b*, 14*c*, 14*d*, 14*e* enables the steps to collapse progressively, starting from the outermost one, into the corresponding blind cavity 16, thus cushioning the impact, while the stepped shape makes it possible to provide the elastic yield by returning the propulsive energy until the protrusions are returned to the original shape structure, ready for another cycle of impact/cushioning and elastic yield/propulsion.

The axial cavities 16 also have the advantage of contributing to lighten the mid-sole 10.

The arrangement and the size of each one of the protrusions 14, 14*a*, 14*b*, 14*c*, 14*d*, 14*e*, as well as their concentration on the bottom surface 15, are defined as a function of the desired cushioning function, elastic yield and desired propulsion correlated with the anatomical shape structure of the foot of the user and of the type of activity performed by the user.

In the figures, the mid-sole 10 according to the disclosure is shown as being provided with a tread 25, which should be understood as not being part of the disclosure.

Thus it has been found that the disclosure fully achieves the intended aims and advantages, a mid-sole for shoes having being obtained that is capable of adapting rapidly to the movements and to the shape structure of the foot of the user, while at the same time having good cushioning and thrust characteristics.

Furthermore, with the disclosure a mid-sole has been devised that ensures that the cushioning and thrust capacities are maintained over time and that an adequate level of anatomical adaptation is achieved even for users with problems of overpronation or of excessive supination.

The materials used as well as the dimensions of the individual components of the disclosure may be more relevant according to specific requirements.

The characteristics indicated above as advantageous, convenient or the like, may also be missing or be substituted by equivalent characteristics.

The disclosures in Italian Patent Application No. 102016000073012 (UA2016A005146) from which this application claims priority are incorporated herein by reference.

The invention claimed is:

1. A mid-sole for a shoe, the mid-sole comprising: a body on which there is a lower portion for joining to a tread and an upper portion for supporting an insole, wherein said upper portion comprises a plurality of elastically compressible protrusions that protrude toward an outside of said body from a bottom surface of said upper portion and wherein each protrusion, of the plurality of elastically compressible protrusions, has an end surface that is flat, so as to define with end surfaces of the other protrusions, of the plurality of elastically compressible protrusions, an external surface for resting the insole, the external surface having a first anatomical shape, wherein a height of each of the plurality of elastically compressible protrusions varies according to a second anatomical shape of the bottom surface in a region of the mid-sole of which each of the plurality of elastically compressible protrusions is a part, wherein top surfaces of the plurality of elastically compressible protrusions are disposed towards said upper portion, facing away from said lower portion, said top surfaces of the plurality of elastically compressible protrusions having a first angle of curvature in a forefoot region of the mid-sole that changes along a longitudinal axis of the mid-sole such that there is a second angle of curvature disposed towards a heel region of the mid-sole, wherein each of the plurality of elastically compressible protrusions is constituted by a stepped frustum-shaped raised portion configured to be disposed towards a foot, said elastically compressible protrusions having a respective quantity of steps that varies according to the position of the respective protrusions along the longitudinal axis of the mid-sole.

2. The mid-sole according to claim 1, wherein each one of said plurality of elastically compressible protrusions has a blind cavity that is open towards the outside of the body.

3. The mid-sole according to claim 2, wherein said blind cavity is coaxial to a frustum-shaped contour of each of the plurality of elastically compressible protrusions in which it is defined.

4. The mid-sole according to claim 1, wherein said body is contoured to contain a sole of a foot.

5. The mid-sole according to claim 1, wherein said bottom surface is plantar-shaped.

6. The mid-sole according to claim 1, wherein the mid-sole is surrounded by an outer perimetric edge for containing the insole.

7. The mid-sole according to claim 1, wherein the mid-sole is provided in a single piece.

8. The mid-sole according to claim 1, wherein the mid-sole is provided in a single piece with a material that has elastic characteristics, in order to facilitate return of the mid-sole to an original shape during use of the shoes, and has a density between 0.15 g/cm$^3$-1.20 g/cm$^3$ and a hardness between 15 Shore A-60 Shore A, wherein the material is selected from the group consisting of styrene-butadiene-styrene (SBS) rubber, natural rubber (NR), rubber and ethylene vinyl acetate (EVA), thermoplastic polyurethane (TPU) and two-component (polyol-isocyanate) expanded polyurethane (EP).

* * * * *